United States Patent [19]

Czubak

[11] 3,987,591

[45] Oct. 26, 1976

[54] HONING TOOL WITH REVERSIBLE BODY SLEEVE

[75] Inventor: Albin Stanley Czubak, Holland, Mich.

[73] Assignee: Ex-Cell-O Corporation, Troy, Mich.

[22] Filed: Jan. 26, 1976

[21] Appl. No.: 652,258

[52] U.S. Cl. ..... 51/338; 51/346

[51] Int. Cl.[2] ..... B24B 33/08

[58] Field of Search ..... 51/338, 339, 340, 342, 51/343, 344, 346

[56] References Cited

UNITED STATES PATENTS

| | | | |
|---|---|---|---|
| 3,138,902 | 6/1964 | Crowe | 51/346 |
| 3,405,049 | 10/1968 | Czubak | 51/338 X |
| 3,507,077 | 4/1970 | Magsig | 51/338 |
| 3,861,091 | 1/1975 | McDonald | 51/344 X |

*Primary Examiner*—Al Lawrence Smith
*Assistant Examiner*—Nicholas P. Godici
*Attorney, Agent, or Firm*—James H. Bower; Mitchell J. Hill

[57] ABSTRACT

A honing tool having an elongated tubular body adapted to be supported for rotational movement about a longitudinal axis in a bore of a workpiece, and adapted for reciprocation in said bore. The tubular body has a reduced diameter lower end on which is slidably mounted a symmetrical, reversible body shell which is secured to said body by a pair of symmetrical, reversible drive keys and a retainer end plug. A plurality of transverse and longitudinally extended slots are formed through the body shell and the reduced diameter lower end of the body, at evenly spaced radial positions, for the reception in each of the slots of a single honing stone which has an outer face that is convexly formed. A stone expander is operatively mounted in each of said slots, against the inner side of the honing stone in each respective slot, for pushing the honing stones outwardly into operative engagement with a bore to be finished. Each of said honing stone expanders is provided with retainer means for retaining the honing stone expanders in their respective slots when the honing stones are removed from the slots, and for retaining the honing stones in their slots when mounted therein. An expansion cone is operatively mounted within the honing body for operative engagement with the stone expanders.

15 Claims, 8 Drawing Figures

FIG. 1
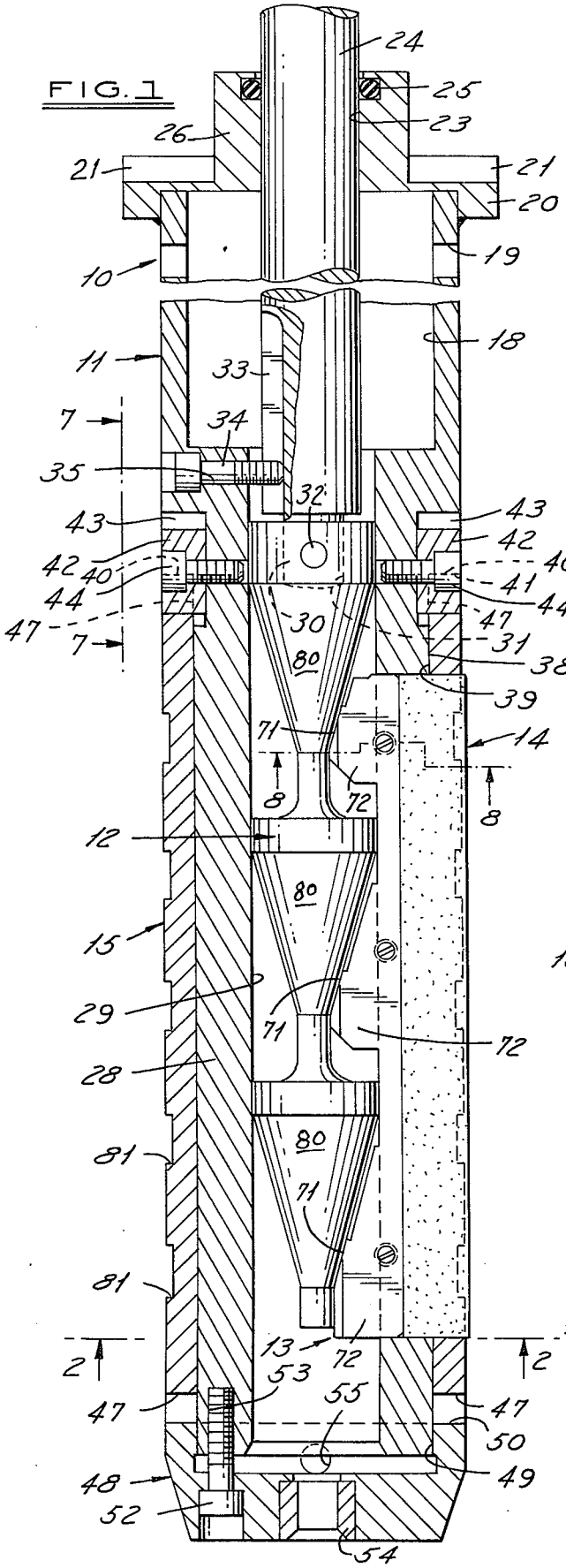
FIG. 3
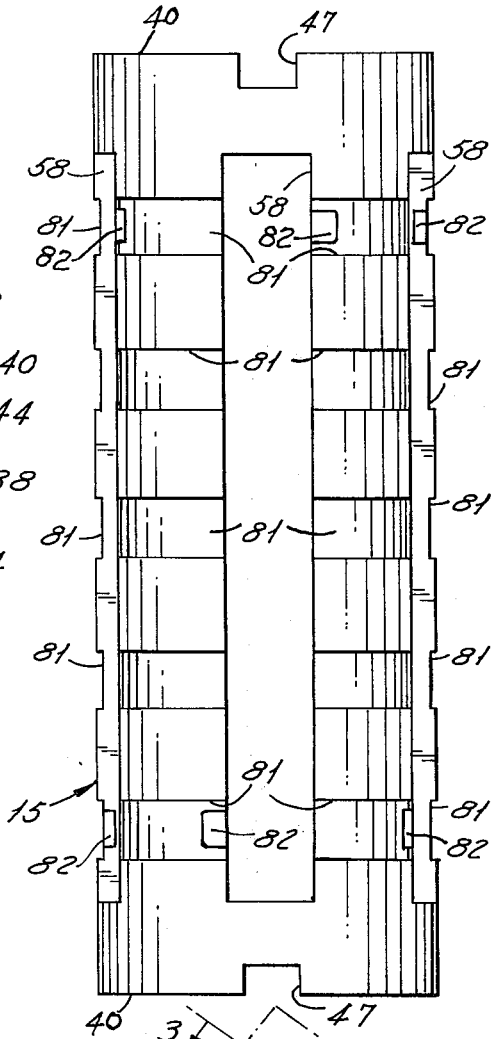
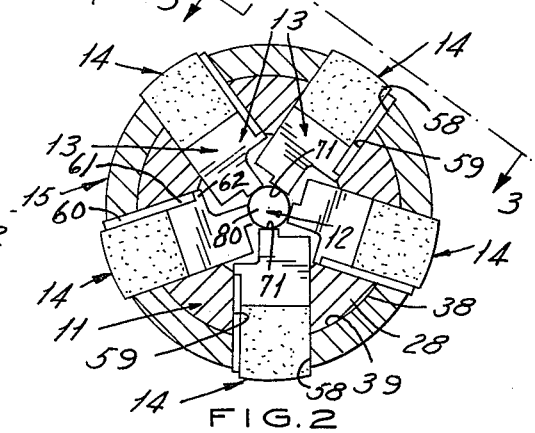
FIG. 2

HONING TOOL WITH REVERSIBLE BODY SLEEVE

SUMMARY OF THE INVENTION

This invention relates to the honing tool art, and more particularly, to a novel and improved honing tool incorporating a reversible body sleeve and a minimum number of novel and improved honing stones.

Honing tools have been provided heretofore for enlarging bores in a workpiece, and for providing a desired finish to the surface of a bore. A disadvantage of the prior art honing tools is that they are one-piece tools, and when the slots carrying the abrasive assemblies or honing stones wear out, the entire tool has to be replaced. The replacement of an entire tool involves the time required to set up and indicate a complete tool which makes such an operation time consuming and costly. A further disadvantage of the prior art honing tools is that they require a large number of honing stones, as for example, twelve stones. A further disadvantage of the prior art honing tools is that the volume of abrasive available in each of the honing stones employed in such tools is limited.

In view of the foregoing, it is an important object of the present invention to provide a novel and improved honing tool which incorporates a novel body construction and honing stone arrangement that overcomes the aforementioned disadvantages of the prior art honing tools and honing stone constructions.

It is another object of the present invention to provide a novel and improved honing tool which is simple in construction, economical and feasible to manufacture, and which is efficient, economical and reliable in operation.

It is a further object of the present invention to provide a novel and improved honing tool which employs a reduced number of honing stones which have a greater abrasive surface contact and volume than the prior art honing stones.

It is still a further object of the present invention to provide a novel and improved honing tool which includes an elongated, tubular body adapted to be supported for rotational movement about the longitudinal axis in a bore in a workpiece, and adapted for reciprocation in said bore. The honing tool body is provided on one end thereof with a reduced diameter on which is slidably mounted a symmetrical, reversible body sleeve which is secured to the honing tool body by a pair of reversible drive keys and a retainer end plug. A plurality of longitudinally extended transverse slots are formed through the body sleeve and the reduced diameter portion of the honing tool body for the reception of a honing stone in each slot. An expansion means is mounted in each slot behind each stone for pushing the stone outwardly into honing engagement with the surface of a bore. Each of the expansion means in each slot is provided with retainer means for retaining individually each of said stones and expansion means in the honing tool body and body shell. An expansion cone for operating the expansion means in each of said slots is operatively mounted in the honing tool body. The body shell and the drive keys may be reversed when the trailing edges of the slots and trailing surfaces on the drive keys are worn out, so as to provide a double life for these parts. The honing tool body need only be set up initially and indicated without the need for further indication when the body shell and drive keys are reversed or replaced, or when the honing stones are replaced.

Other features and advantages of this invention will be apparent from the following detailed description, appended claims, and the accompanying drawings.

BRIEF DESCRIPTION OF THE DRAWINGS

FIG. 1 is a broken, elevational section view of a honing tool made in accordance with the principles of the present invention.

FIG. 2 is a transverse section view of the honing tool structure illustrated in FIG. 1, taken along the line 2—2 thereof, and looking in the direction of the arrows.

FIG. 3 is a side elevation view of a body shell employed in the honing tool structure of the present invention, taken along the line 3—3 of FIG. 2, with the honing stones removed, and with the shell removed from the honing tool body.

DESCRIPTION OF THE PREFERRED EMBODIMENT

Figure 4:
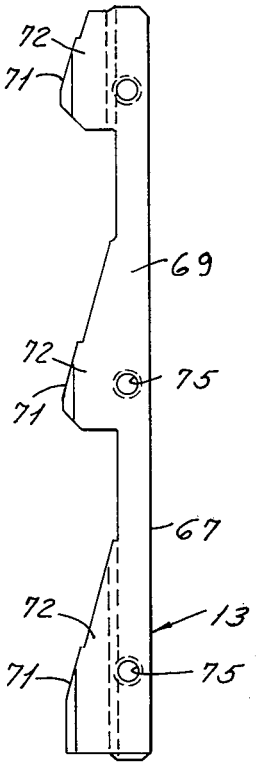
FIG. 4 is a side elevation view of a stone expander employed in the structure of the honing tool structure illustrated in FIG. 1.

Referring now to the drawings, and in particular to FIG. 1, the numeral 10 generally designates a honing tool made in accordance with the principles of the present invention. The honing tool 10 includes an elongated, cylindrical body, generally indicated by the numeral 11, in which is slidably mounted an expansion cone, generally indicated by the numeral 12.

As shown in FIG. 2, the expansion cone 12 is adapted to operate a plurality of honing stone expanders which are each generally indicated by the numeral 13. A total number of five honing stone expanders 13 are employed in the embodiment for expanding outwardly an equal number of abrasive assemblies or honing stones which are each generally indicated by the numeral 14. The honing tool 10 further includes a symmetrical, reversible body sleeve, generally indicated by the numeral 15, which is described in detail hereinafter.

As shown in FIG. 1, the honing tool body 11 has a cylindrical chamber 18 formed in the upper end thereof, which is enclosed by a collar 20 and an integral cap structure which includes a journal 26. The last mentioned collar and cap structure is fixedly secured to the honing body 11 by any suitable means, as by being brazed thereto. The honing tool body chamber 18 is adapted to be vented or drained to the atmosphere by a plurality of suitable drain holes 19. The collar 20 is provided with a suitable groove 21 for connecting the body 11 to a suitable drive means for providing rotation and reciprocation of the honing tool 10 about its longitudinal axis.

The expansion cone 12 is connected to a suitable drive shaft or cone rod 24 which is slidably mounted through a bore 23 formed through the cap structure journal 26. A suitable O-ring seal means 25 is operatively mounted in the journal 26 about the bore 23 for sealing engagement with the cone rod 24.

The expansion cone 12 is slidably mounted in an axial cone bore 29 formed through a reduced diameter lower end portion 28 of the body 11. The bore 29 communicates at its upper end with the body chamber 18. The inner end of the cone rod 24 extends into the cone bore 29, and it has a reduced diameter end shaft 30 that is slidably mounted in a bore 31 formed in the upper end of the expansion cone 12. A retainer pin 32 operatively connects the cone rod shaft 30 to the expansion cone 12. The cone rod 24 is provided with a longitudinally extended groove 33, on the inner end thereof, for the sliding reception of the end of a machine screw 34 which is operatively mounted in a transverse threaded bore 35 formed in the upper end of the honing body 11. The function of the groove 33 and the screw 34 is to prevent rotation of the cone rod 24 and the expansion cone 12, and yet permit reciprocation of these parts.

Figure 7:
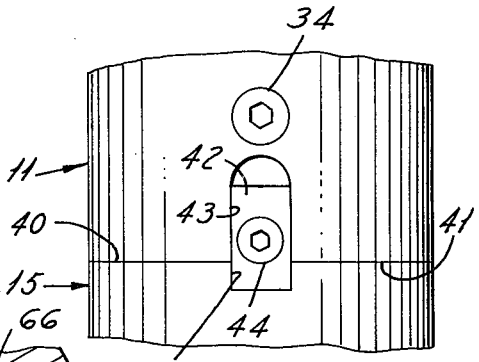
FIG. 7 is a fragmentary, side elevation view of the honing tool structure illustrated in FIG. 1, taken along the line 7—7 thereof, and looking in the direction of the arrows.

As shown in FIG. 2, the outer periphery of the reduced diameter lower end portion 28 of the honing body 11 is cylindrical, and it is slidably received within the cylindrical chamber 39 in the body shell 15 when said body shell is slidably mounted over the body portion 28. The ends of the body shell 15 are indicated by the numerals 40. The body shell 15 is symmetrical, so that it may be reversed in position on the lower end body portion 28. As best seen in FIG. 7, the inner end of the body shell 15 is adapted to be seated against a shoulder 41 which is formed at the junction of the upper end of the body 11, and the body lower end portion 28. The body shell 15 is retained against rotation on the body 11 by a pair of rectangular retainer keys 42 which are symmetrical and which may be reversed in position. The honing tool body 11 is provided with a pair of diametrically disposed retainer key slots 43 which are adapted to be in line with a similar pair of retainer key slots 47 formed at each of the ends of the body shell 15. As shown in FIG. 7, each of the retainer keys 42 extends partially into one of the retainer key slots 43 in the body 11 and into one of the retainer key slots 47 on the body shell 15. Each of the retainer keys 42 is secured in position by a suitable lock screw 44.

As shown in FIG. 1, the body shell 15 is axially retained in position against the body shoulder 41 by a retainer plug or nose plug, generally indicated by the numeral 48. The retainer plug 48 has formed on its inner side a cylindrical recess 49 in which is received the lower end of the body reduced diameter lower end portion 28. The retainer plug 48 has a shoulder 50 formed around the inner end thereof which seats against the lower shoulder 40 on the body shell 15. The retainer plug 48 is fixed in position on the body lower end portion 28 by a plurality of suitable machine screws 52 which are threadably mounted in suitable threaded bores 53 formed in the lower end of the body portion 28. A sizing gage fitting 54 is operatively mounted in the retainer plug 48. The retainer plug 48 is also provided with a suitable drain hole 55.

As best seen in FIG. 2, the body shell 15 is provided with a plurality of transverse and longitudinally extended radial slots 58 which are equally spaced about the periphery of the body shell 15. Each of the slots 58 in the body shell 15 communicates with an aligned slot 59 which is formed through the body lower end portion 28, and which communicates with the cone bore 29 in the body portion 28. One of the honing stones 14 is slidably mounted in each of the pairs of aligned slots 58 and 59, with its convexly shaped outer face 63 disposed in a position projected outwardly of the periphery of the body shell 15.

Figure 5:
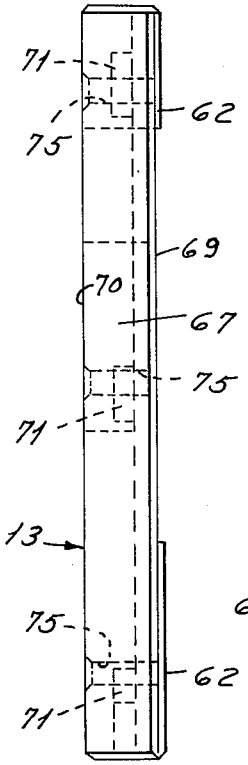
FIG. 5 is a right side elevation view of the stone expander illustrated in FIG. 4.
Figure 6:
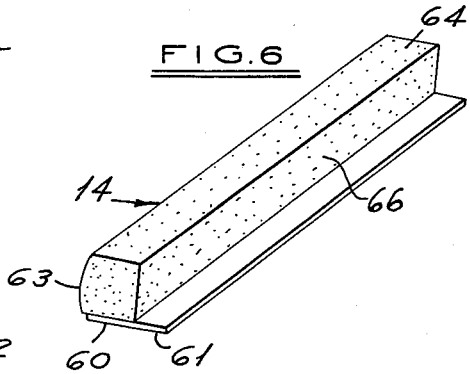
FIG. 6 is a perspective view of a honing stone employed in the honing tool structure illustrated in FIG. 1.
Figure 8:
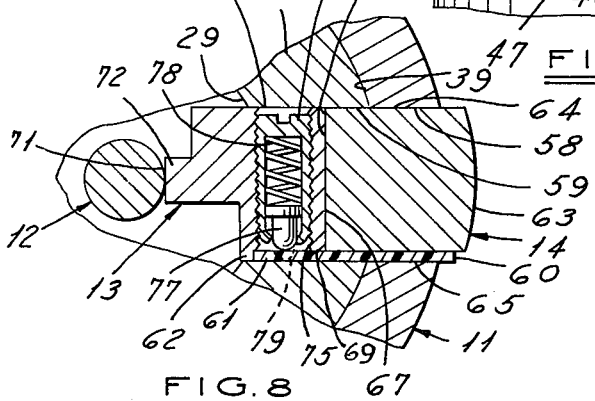
FIG. 8 is a fragmentary, enlarged, horizontal section view of the honing tool structure illustrated in FIG. 1, taken along the line 8—8 thereof, and looking in the direction of the arrows.

As best seen in FIGS. 6 and 8, each of the honing stones 14 is provided along one of its parallel side faces with a wear plate 60 which is made from any suitable, wearable material, such as aluminum, plastic and the like, which is adhered to the body of the honing stone 14 by any suitable means, as by a suitable adhesive. An inner portion 61 of each of the wear plates 60 extends beyond the inner face 66 of the honing stone, and into slidable engagement with a side face 69 of the adjacently disposed honing stone expander 13. The honing stone expander 13 positioned in each of the slots 59 has its outer or front face 67 in abutting engagement with the rear face 66 of the adjacent stone 14. A pair of spaced lips 62 are formed on the side 69 of each of the honing stone expanders 13. The inner ends of the wear plate portion 61 are adapted to be near the lips 62 when the stone 14 is operatively mounted in the honing tool, as shown in FIG. 8. The other side face of each of the honing stone expanders 13 is indicated by the numeral 70. The outer side face of each of the wear plates 60 is indicated by the numeral 65, and it slidably engages one side of the slots 58 and 59. The side face 64 of each of the honing stones 14 has a slight clearance on the opposite side of each of the bores 58 and 59. As shown in FIGS. 4 and 5, each of the honing stone expanders 13 is provided with three rearwardly extended cone angle arms 72 which have formed on their rear faces a blade shaped angle or tapered edge which may be termed a cone angle 71. As shown in FIGS. 1 and 8, each of the cone angles 71 is adapted to be slidably engaged by one of a plurality of cones 80 which is formed on the expansion cone 12, for biasing the stone expanders 13 and stones 14 outwardly.

Each of the honing stone expanders 13 is provided with a means for retaining the expanders 13 and the adjacent stone 14 in the slots 58 and 59, and it comprises a spring plunger means. As best seen in FIG. 5, three transverse threaded bores 75 are formed transversely through each of the honing stone expanders 13, at evenly spaced apart positions. However, it will be understood that one or more bores 75, as desired, may be employed. A cylindrical spring carrier body 76 is threadably mounted in each of the threaded bores 75, (FIG. 8), and it carries a ball nose plunger 77, and a spring 78 for biasing the ball nose plunger 77 outwardly through an opening in one end of the carrier 76 and into friction engagement with the wear plate portion 61, as shown in FIG. 8. A spring and ball means may be used alternatively in the expander 13. When the stone 14 is removed from its respective position in the honing tool, the spring 78 functions to move the plunger 77 outwardly to the position shown by the numeral 79 in FIG. 8, into friction engagement with the adjacent wall surface of the slot 59 to retain the respective honing stone expander 13 in its respective slot 59.

The body shell 15 is provided with a plurality of peripheral grooves 81 for conducting coolant about the tool 10. The grooves 81 are circumferentially spaced along the body shell 15. Two notches 82 are provided in each of the grooves 81, with one notch 82 on each side of each of the honing stone slots 58, at opposite ends, for the reception of a tool, as a screwdriver, for quick and easy removal of a honing stone 14 from a slot 58. The various parts of the honing tool may be made from any suitable material, as for example, a suitable tool steel.

In use, a honing stone 14 is mounted in each of the slots 58 and moved into the adjacent slot 59 by an inward pressure. The inner end 61 of the wear plate 60 is adapted to move the ball nose plungers 77 inwardly to their retracted positions as shown in FIG. 8, when the stones 14 are pushed inwardly to the position shown in FIG. 8. The cone rod 24 functions to move the expansion cones 80 downwardly, as viewed in FIG. 1, for a honing operation when the honing tool 10 is simultaneously reciprocated and rotated by a suitable drive means. The cone angles 71 on the inner ends of each of the honing stone expanders 13 are engaged by the cones 80 to move the honing stone expanders 13 outwardly and maintain a radial outward force on the stones 14. When the stones or abrasive means 14 wear down to a point where the stone expanders 13 are exposed, the worn honing stones 14 may be quickly and easily removed by inserting a screw driver or other tool in the slots 82, and exerting a radial outward pressure thereon to remove the stones 14. New honing stones 14 may be quickly and easily inserted into the honing tool, as described hereinbefore.

It will be seen that the honing stones 14 provide a honing stone which has a large volume and a large abrasive operating surface. The body sleeve 15 is symmetrical about its centerline, so as to provide a double life for this part. For example, if the rotation of the tool is in a clockwise direction, as viewed in FIG. 2, then the trailing edges of the slots 58 will wear during a honing operation. When the trailing edges of the slots 58 wear out, the body sleeve 15 may be quickly and easily removed and reversed in position, to permit the opposite sides of the slots 58 to function as the trailing edges. The retainer keys 42 may also be reversed in position when their edges wear to the point where they must be reversed to permit use of the unworn side. The honing tool 10 of the present invention is more efficient than the prior art one-piece body assemblies, since the entire honing tool does not have to be replaced due to wear conditions, but only the body sleeve 15 and the retainer keys 42. The arrangement and construction of the honing tool of the present invention also permits the use of a smaller number of honing stones, and provides stones that have a larger abrasive volume than the prior art honing stones. The honing stones 14 are longer and wider than the prior art stones and accordingly, provide a greater abrasive working face area on each stone. From the foregoing, it will be seen that the honing tool of the present invention provides improved honing efficiency at less cost than the prior art honing tools.

While it will be apparent that the preferred embodiment of the invention herein disclosed is well calculated to fulfill the objects above stated, it will be appreciated that the invention is susceptible to modification, variation and change.

I claim:

1. In a honing tool, the combination comprising:

a. an elongated body constructed for rotational movement about a longitudinal axis in a bore of a workpiece and for reciprocation in said bore, and having a longitudinal chamber formed therein, and at least one radial and longitudinally extended slot formed in said body and communicating with said chamber and the exterior of said body;

b. a body sleeve mounted on said body and having at least one radial and longitudinally extended slot formed therethrough and aligned with said slot in said body;

c. at least one honing stone mounted in said aligned slots in said body and body sleeve; and, d. expansion means mounted in said body for pushing said stone outwardly into operative engagement with the surface of said workpiece bore for honing engagement therewith.

2. A honing tool as defined in claim 1, including:

a. retainer means carried by said expansion means for retaining said honing stone in said body.

3. A honing tool as defined in claim 2, wherein said retainer means includes:

a. pressure means carried by said expansion means for holding the stone in said slot by friction engagement with the side surfaces of one of said slots.

4. A honing tool as defined in claim 1, wherein:

a. said elongated body is provided with a plurality of radial and longitudinally extended slots;

b. said body sleeve is provided with a plurality of radial and longitudinally extended slots formed therethrough and aligned with said plurality of said slots in said body to form a plurality of sets of aligned slots; and, c. a honing stone is operatively mounted in each of the sets of aligned slots in said body and body sleeve.

5. A honing tool as defined in claim 4, including:

a. retainer means carried by said expansion means for retaining said honing stones in each of their respective sets of aligned slots.

6. A honing tool as defined in claim 5, wherein said retainer means includes:

a. pressure means carried by said expansion means for holding the stones in said slots by friction engagement with the side surfaces of one of said slots.

7. A honing tool as defined in claim 5, wherein:

a. said body sleeve is symmetrical and may be used in reversed positions on said elongated body.

8. A honing tool as defined in claim 7, including:

a. means for releasably securing said body sleeve on said elongated body.

9. A honing tool as defined in claim 8, wherein:

a. said means for releasably securing said body sleeve on said elongated body includes at least one retainer key.

10. A honing tool as defined in claim 9, wherein:

a. said retainer key is symmetrical and may be used in reversed positions for securing said body sleeve on said elongated body.

11. A honing tool as defined in claim 7, including:

a. means for releasably securing said body sleeve on said elongated body and including a retainer end plug for retaining the body sleeve against longitudinal movement, and at least one symmetrical retainer key for retaining the body sleeve against rotational movement.

12. A honing tool as defined in claim 7, wherein said expansion means includes:

a. a stone expander movably mounted in each of said sets of aligned slots for abutting engagement with the honing stone mounted therein;

b. a cone means movably mounted in said longitudinal chamber in said body and engaged with each of the stone expanders for moving the honing stones radially outward of the body.

13. A honing tool as defined in claim 12, wherein:

a. said pressure means includes a spring biased means carried by each of said stone expanders.

14. A honing tool as defined in claim 13, wherein:

a. each of said honing stones is provided with an inwardly extended wear plate engagable by the spring biased means carried by the adjacent stone expander.

15. A honing tool as defined in claim 13, wherein:

a. each of said stone expanders includes at least one cone angle; and, b. said cone means includes at least one cone engaged with said at least one cone angle.

* * * * *